US008305408B2

(12) United States Patent
Launie et al.

(10) Patent No.: US 8,305,408 B2
(45) Date of Patent: Nov. 6, 2012

(54) NONROTATING PLATEN FOR THERMAL PRINTING

(75) Inventors: Kenneth J. Launie, Cambridge, MA (US); Leo R. Lechtenberg, Middleboro, MA (US); Juan C. Van Dijk, Sudbury, MA (US); William T. Vetterling, Lexington, MA (US)

(73) Assignee: Zink Imaging, Inc., Bedford, MA (US)

( * ) Notice: Subject to any disclaimer, the term of this patent is extended or adjusted under 35 U.S.C. 154(b) by 999 days.

(21) Appl. No.: 11/753,753

(22) Filed: May 25, 2007

(65) Prior Publication Data

US 2007/0279478 A1 Dec. 6, 2007

Related U.S. Application Data

(60) Provisional application No. 60/808,885, filed on May 26, 2006.

(51) Int. Cl.
*B41J 2/32* (2006.01)
*B41J 2/38* (2006.01)

(52) U.S. Cl. ..... 347/171; 347/185; 347/186; 347/187

(58) Field of Classification Search ..... 347/171, 347/220, 221, 185–187
See application file for complete search history.

(56) References Cited

U.S. PATENT DOCUMENTS

| | | | | |
|---|---|---|---|---|
| 4,725,853 | A * | 2/1988 | Kobayashi et al. | 347/197 |
| 4,840,500 | A * | 6/1989 | Sasaki et al. | 347/200 |
| 5,425,588 | A * | 6/1995 | Stemmle | 400/649 |
| 5,448,282 | A * | 9/1995 | Imai et al. | 347/213 |
| 5,797,687 | A * | 8/1998 | Petersen et al. | 400/23 |
| 6,011,572 | A * | 1/2000 | Osakama et al. | 347/197 |
| 2004/0241578 | A1 * | 12/2004 | Hirai | 430/270.1 |
| 2005/0151815 | A1 * | 7/2005 | Kanai et al. | 347/102 |
| 2008/0018690 | A1 * | 1/2008 | Nishida | 347/18 |

* cited by examiner

*Primary Examiner* — Stephen Meier
*Assistant Examiner* — Sarah Al Hashimi
(74) *Attorney, Agent, or Firm* — Foley & Lardner LLP; Michel Morency; Daniel E. Rose

(57) ABSTRACT

Devices and methods for thermally printing on a thermal image member are disclosed using a thermal print head and a nonrotating platen. The nonrotating platen is adapted to bias the thermal imaging member against the print head. The nonrotating platen includes an elastic member and a mounting means for securing at least one end of the elastic member with respect to the print head. A portion of the thermal imaging member is placed in a printing nip formed between a thermal print head and the nonrotating platen. The print head exerts a torque on the elastic member when the elastic member biases the imaging member against the print head. The thermal imaging member is translated along a transport direction through the printing nip, such that at least one surface of the imaging member slides across the nonrotating platen. The print head forms an image upon the translated thermal imaging member.

7 Claims, 8 Drawing Sheets

NONROTATING PLATEN FOR THERMAL PRINTING

CROSS-REFERENCE TO RELATED APPLICATIONS

The present application claims the benefit of prior U.S. Provisional Patent Application Ser. No. 60/808,885, filed May 26, 2006, which application is incorporated herein by reference in its entirety.

This application is related to the following commonly assigned, United States patent applications and patents, the entire disclosures of which are hereby incorporated by reference herein in their entirety:

U.S. patent application Ser. No. 10/151,432, filed on May 20, 2002, entitled "Thermal Imaging System", now U.S. Pat. No. 6,801,233;

U.S. patent application Ser. No. 11/400,735, filed on Apr. 6, 2006;

U.S. patent application Ser. No. 11/400,734, filed on Apr. 6, 2006; and

U.S. patent application Ser. No. 11/524,476, filed on Sep. 20, 2006.

FIELD OF THE INVENTION

The present invention relates generally to a digital printing system. More specifically, the invention relates to a thermal printer comprising a nonrotating platen.

BACKGROUND OF THE INVENTION

In some types of thermal printing, an assembly known as a thermal printing head, that includes a linear array of heating elements, is used to heat a thermal imaging member in order to effect a change of color. The thermal printing head typically spans the thermal imaging member perpendicular to the transport direction. The thermal imaging member may be, for example, a sheet of paper coated with a thermally-sensitive composition or a donor element for dye transfer. For heating to occur with efficiency, the thermal printing head and the imaging member that is heated must be in good thermal contact. A typical practice to ensure sufficiently intimate contact is to use a platen roller located on the opposite side of the imaging member to the thermal printing head, and to apply pressure between the platen roller and the thermal printing head to bias the thermal imaging member against the thermal printing head. The platen roller often includes a deformable rubber coating that provides uniform pressure across an area referred to as the printing nip separating the platen roller from the thermal printing head.

Unfortunately, the use of a platen roller introduces a number of difficulties into the design of a thermal printer. The alignment of the line of heating elements of the thermal printing head with the axis of rotation of the platen roller is often imperfect, leading to various problems that include steering of the thermal imaging member in a direction that is not perpendicular to the line of heating elements. Eccentricity and other defects of the platen roller may introduce periodic artifacts into the printed image. Additionally, the required diameter of the platen roller introduces a constraint that may limit the compactness of the thermal printer.

There are, moreover, undesirable thermal effects that derive from the use of a platen roller that is coated with a material, such as rubber, that has poor thermal conductivity. Heat may be conducted through a thermal imaging member while it is being printed, and lead to an increase in temperature of the platen roller. When the platen roller is a poor conductor of heat, such a temperature change may be quite substantial (on the order of a few degrees Celsius). Such a temperature increase of the platen roller may lead to an undesirable change in the density of an image that is printed onto the thermal imaging member.

All these issues have led to the development of non-rotating platens such as are described, for example, in U.S. Pat. Nos. 4,327,366, 4,725,853, and 7,027,077. In these examples, pressure is provided by a spring that is independent from the platen itself in order to bias the platen (and therefore the thermal imaging member with which it is in contact) against a thermal printing head. In no case, however, is the spring described as an integral part of the platen itself.

SUMMARY OF THE INVENTION

It is therefore an object of this invention to provide a novel platen for use in a thermal printer.

It is another object to provide a nonrotating platen for use in a thermal printer.

It is yet another object of the invention to provide a nonrotating platen that is composed of an elastic material.

Another object is to provide a thermal printer comprising a rigid frame, a thermal printing head attached to the rigid frame, and a nonrotating platen that comprises an elastic member attached to the rigid frame by a mounting means, wherein the nonrotating platen is adapted to bias a thermal imaging member against the thermal printing head for printing purposes with approximately equal pressure across the width of the thermal printing head, and wherein the thermal printing head exerts a torque on the elastic member.

A further object is to provide a nonrotating platen comprising a heating means.

Yet another object is to provide thermal printer comprising a thermal printing head and a nonrotating platen comprising a heating means, in which the heating means is configured to heat a thermal imaging member before it is heated by the thermal printing head.

In one aspect, the invention relates to a thermal printer including a rigid frame having a thermal printing head attached to the rigid frame. The thermal printer also includes a nonrotating platen adapted to bias a thermal imaging member against the thermal printing head for printing purposes. The nonrotating platen includes an elastic member and a mounting means configured to attach the elastic member to the rigid frame. The thermal printing head exerts a torque on the elastic member when the elastic member is biasing a thermal imaging member against the thermal printing head.

In another aspect, the invention relates to a thermal printer including a thermal printing head and a nonrotating platen that includes a heating element. The nonrotating platen is adapted to bias a thermal imaging member against the thermal printing head for printing purposes with approximately equal pressure across the width of the thermal printing head.

In another aspect, the invention relates to a process for thermally forming an image on a thermal imaging member. The process includes placing a portion of the thermal imaging member in a printing nip formed between a thermal print head and a nonrotating platen. The thermal imaging member is biased against the thermal printing head for printing purposes. The thermal imaging member is translated along a transport direction through the printing nip, such that at least one surface of the thermal imaging member sliding across the nonrotating platen. The thermal print head forms an image upon the translated thermal imaging member.

A thermal printer including nonrotating means for applying pressure to a portion of the thermal imaging member when disposed in a printing nip formed between a thermal print head and the nonrotating means. The printer includes means for biasing the thermal imaging member against the thermal printing head for printing purposes and means for translating the thermal imaging member along a transport direction through the printing nip. At least one surface of the thermal imaging member slides across a stationary portion of the nonrotating means. The thermal print head forms an image upon the translated thermal imaging member.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE INVENTION

Figure 1:
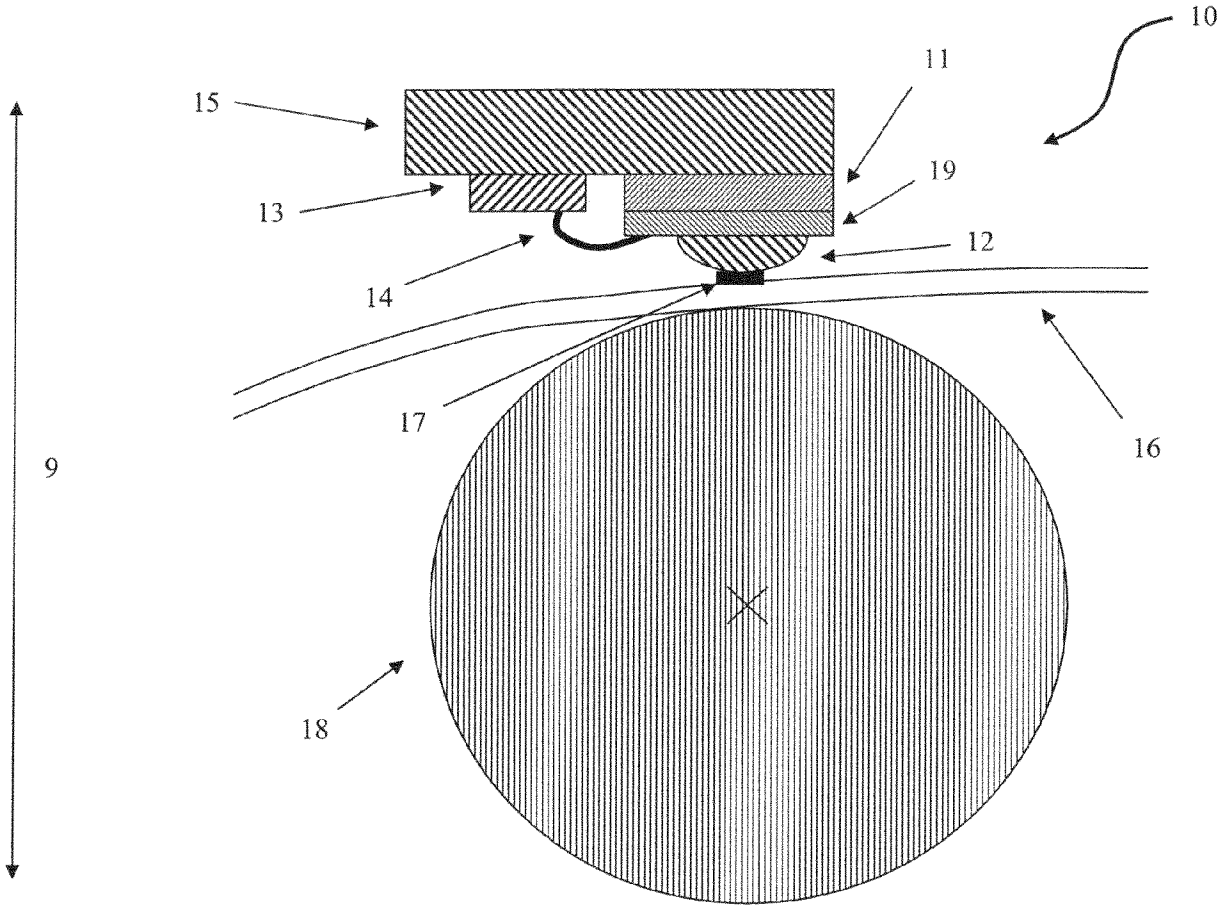
FIG. 1, not to scale, is a cross-sectional view of a thermal printing head and rotating platen arrangement.

Referring now to FIG. 1 there is shown a typical thermal printing arrangement of the prior art in which a thermal printing head assembly 10 and a thermal imaging member 16 are held in intimate contact by a platen roller 18. As shown in FIG. 1, a typical thermal printing head comprises a support 15 that carries the driving circuitry 13 and the assembly comprising the heating elements. The heating elements 17 are carried by a glaze layer 19 in contact with a ceramic substrate 11. Ceramic substrate 11 is in contact with support 15. Shown in the figure is an optional raised "glaze bump" 12 on which the heating elements 17 are located, but they may also be carried by the surface of glaze 19 when glaze bump 12 is absent. Wires 14 provide electrical contact between the heating elements 17 and the driving circuitry 13.

A deformable coating on the platen roller 18 (for example, a layer of rubber) may be provided to ensure an even contact between the thermal imaging member 16 and the thermal printing head. Even if the thermal imaging member 16 is itself inelastic, use of such a deformable coating may allow the member 16 to conform to the region of the thermal printing head bearing the heating elements. Although FIG. 1 is not drawn to scale, it will be appreciated that a substantial proportion of the total height 9 of this printing arrangement is taken up by the platen roller 18. Reduction in the diameter of the platen roller 18 may be impractical because it may lead to a reduction in the bending stiffness of the roller, and therefore to non-uniform pressure across the width of the roller. The bending stiffness is proportional to the cube of the diameter of the platen roller 18, excluding the deformable coating (if present).

Figure 2:
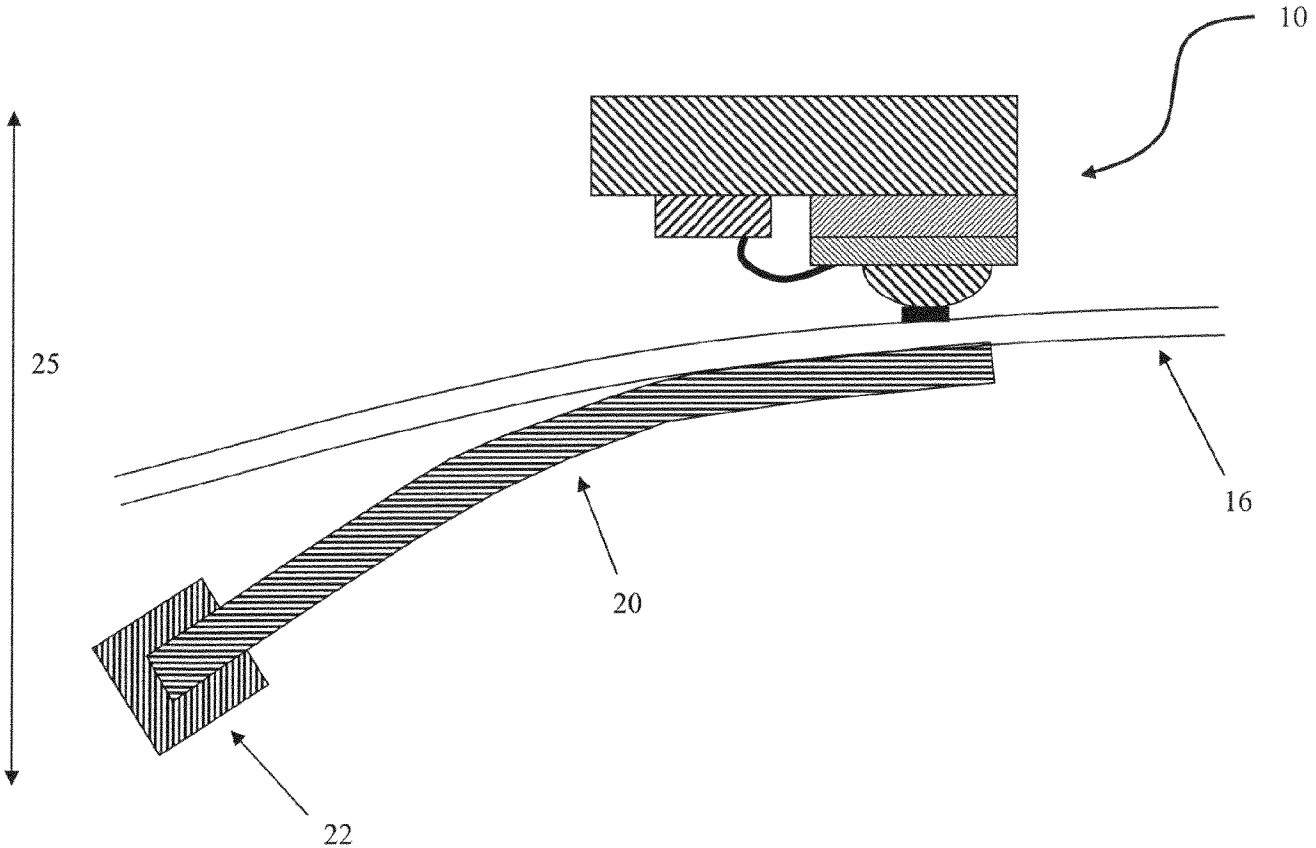
FIG. 2, not to scale, is a cross-sectional view of a thermal printing head and nonrotating platen arrangement of the present invention.

In FIG. 2 is seen an arrangement of a nonrotating platen 20 of the present invention that urges the thermal imaging member 16 into contact with the thermal printing head assembly 10. In this case, the nonrotating platen 20 is composed of a material having a very high elastic modulus, for example, a grade of heat treated steel commonly referred to as "spring steel". The nonrotating platen 20 is held in place at anchor 22, the pressure between the nonrotating platen 20 and the thermal printing head assembly 10 being provided by the elasticity of the nonrotating platen itself. The pressure between the nonrotating platen 10 and the thermal printing head assembly 10 should be in the range of about 0.5 to about 10 pounds-per-linear-inch measured in the direction parallel to the line of heating elements of the thermal printing head. To maintain a uniform pressure across the printing nip, it is preferred that nonrotating platen 20 be stiff longitudinally (i.e., in the direction of transport of the thermal imaging member 16) and of low torsional stiffness perpendicular to this direction. It is also preferred, in this embodiment, that the thermal imaging member 16 itself be somewhat compliant.

Anchor 22 indicates means by which nonrotating platen 20 is rigidly and, in this case, nonrotatably attached to the frame of the printer. The thermal printing head assembly 10 is also attached to the frame of the printer, and in this arrangement the thermal printing head exerts a force on the nonrotating platen 20 that causes it to bend (in other words, the thermal printing head exerts a torque, or bending force, on the elastic nonrotating platen 20).

Nonrotating platen 20 need not consist solely of an elastic material, but must comprise an elastic material such that the force that biases the thermal printing medium 16 against the thermal printing head assembly 10 is provided by the bending of the elastic material.

The advantage of the arrangement of nonrotating platen 20 and thermal printing head assembly 10 of the present invention is that the height 25 shown in FIG. 2 does not have to be as great as the height 9 that was shown in FIG. 1.

The surface of the nonrotating platen 20 should be sufficiently smooth that the frictional drag when transporting the thermal imaging member 16 is minimized, thereby reducing the required size of the driving motor.

It will be appreciated by one of skill in the art that for single pass printing, the arrangement of FIG. 1 allows for a driven rotating platen 18, whereas the arrangement of FIG. 2 of the present invention requires a separate driving mechanism for transporting a thermal imaging member therethrough. Some exemplary thermal imaging member driving mechanisms include one or more driving rollers separate from the nonrotating platen 20. The axis of rotation of the driving rollers can be substantially perpendicular to a transport direction of the thermal imaging member, such that rotation of the roller, when in contact with a surface of the thermal imaging member, causes a translation of the thermal imaging member along the transport direction. Such rollers can be included along one or more sides of the printing nip to push, pull or push and pull a thermal imaging member therethrough. At least one surface of the transported thermal image member slides across a substantially stationary nonrotating platen 20 during printing. Despite this limitation, the advantages of the printing arrangement of the present invention (including reduced height) may still, in some embodiments, lead to its being preferred. In particular, it may be desired to configure a mobile thermal printer for use in conjunction with a handheld device such as a mobile phone, in which case the thickness of the printer is of paramount importance.

Figure 3:
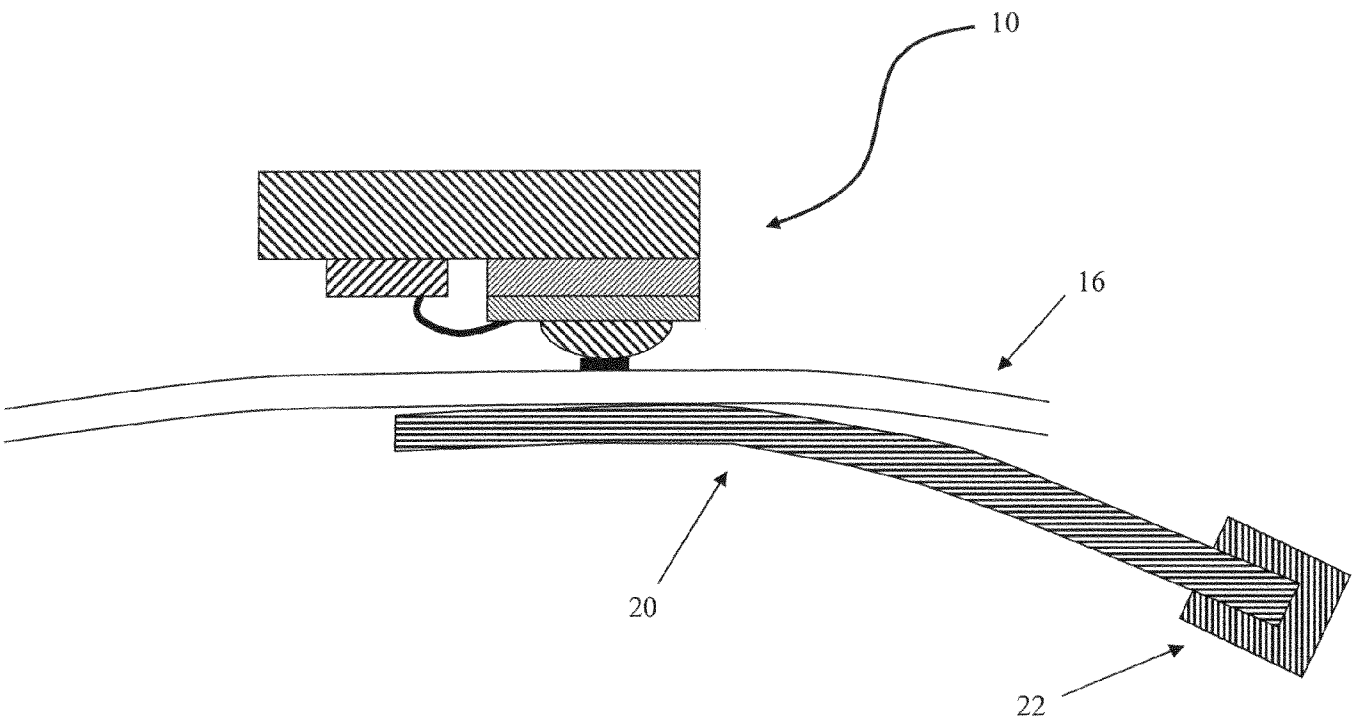
FIG. 3, not to scale, is a cross-sectional view of another thermal printing head and nonrotating platen arrangement of the present invention.

FIG. 3 shows an arrangement of a nonrotating platen 20 of the present invention that is located on the opposite side of the printing nip from the arrangement of FIG. 2. The arrangement of FIG. 3 may be preferred for the case where interference between the driving circuitry 13 or wires 14 and the thermal imaging member 16 must be avoided.

Figure 4:
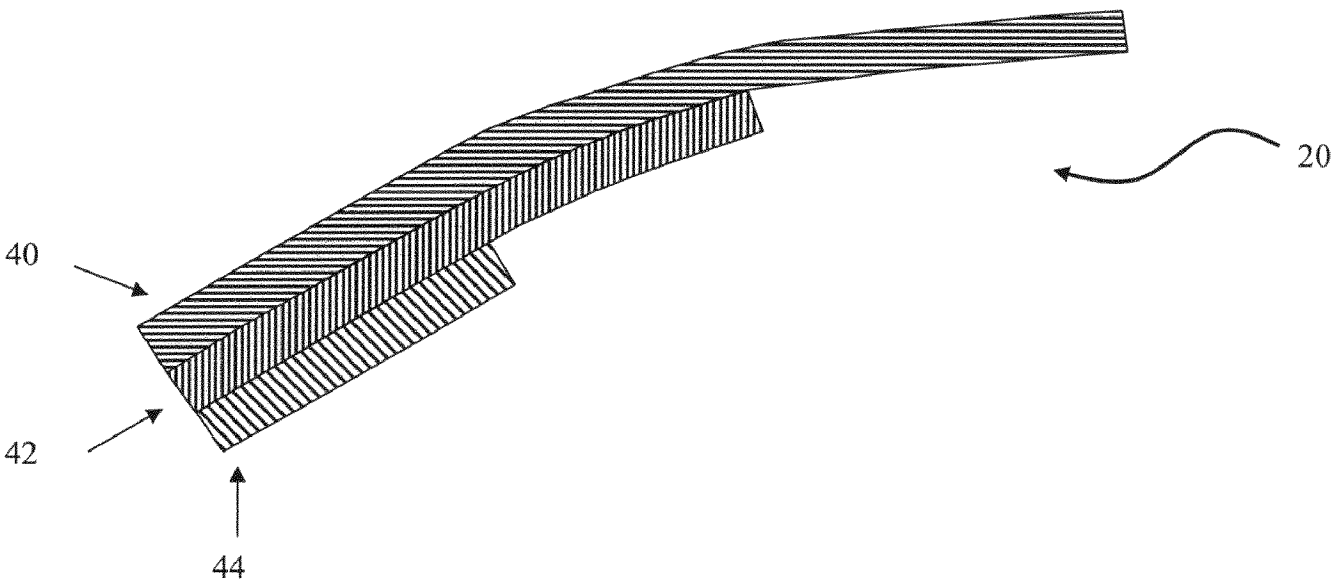
FIG. 4, not to scale, is a cross-sectional view of a nonrotating platen of the present invention.

It is not necessary that the platen 20 of the present invention comprise only a single elastic member. FIG. 4 shows an arrangement in which greater control of the pressure excited by the nonrotating platen 20 may be achieved by a laminar arrangement of elastic elements of different lengths. In FIG. 4, three such elements 40, 42 and 44 are shown, but any number of such elements may be present. Such an arrangement (often referred to as a "leaf spring") will be familiar to those skilled in the art. It is not, of course, necessary that each of the elements 40, 42 and 44 of the nonrotating platen 20 be composed of the same material. Materials that may be chosen include the abovementioned spring steel, plastic, etc.

Figure 5:
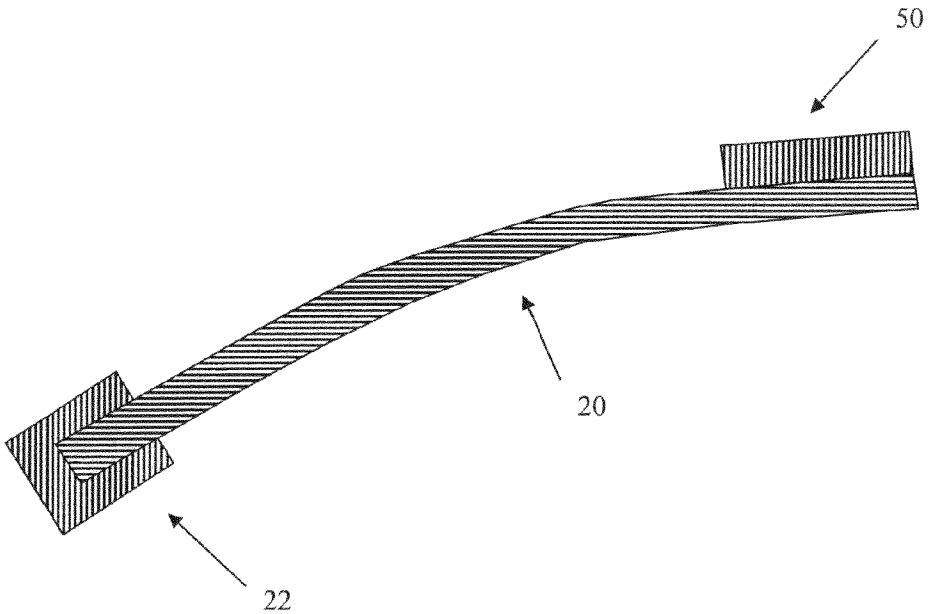
FIG. 5, not to scale, is a cross-sectional view of another nonrotating platen of the present invention.

At the point of contact between the non rotating platen 20 of the present invention and the surface of the thermal imaging member 16 may be provided an image performance improving element 50, shown in FIG. 5, to improve the imaging performance of the thermal printing arrangement. For example, the image performance improving element 50 may be a compliant material that provides for more uniform pressure across the printing nip. This is particularly important when imaging member 16 is not compliant itself. Compliance may be achieved by the image performance improving element 50 including one or more of foam, plastic, or other compliant material, such as is described in U.S. Pat. No. 7,027,077, incorporated herein by reference in its entirety. Alternatively or in addition, the image performance improving element 50 provides a groove that can be aligned with the heating elements of the thermal printing head, in a manner that is described in aforementioned U.S. Pat. No. 7,027,077. In other embodiments, the image performance improving element 50 alternatively or in addition includes a raised rib that can be aligned with the heating elements of the thermal printing head to increase local pressure. In some embodiments, the image performance improving element 50 is a separate piece from the nonrotating platen 20. In other embodiments, the image performance improving element 50 forms an integral part of nonrotating platen 20.

Alternatively or in addition, the image improving element 50 includes a heating element for preheating the thermal imaging member. Preheating of the thermal imaging member is described in more detail in related U.S. patent application Ser. No. 11/400,735. In some embodiments, image improvements can be obtained by heating nonrotating platen 20 itself at any convenient location. For example, a separate heater unit can be used to heat the nonrotating platen 20 by one or more of irradiative, convective, and conductive heat transfer. Some exemplary heating elements include electrical radiators, such as resistive elements, chemical radiators, such as exothermic chemical reactions, hydronic radiators, and infrared radiation sources.

As discussed above, a conventional rubber-coated platen roller 18 may build up heat during printing of a thermal imaging member. The nonrotating platen 20 itself, or the combination of the nonrotating platen 20 and the image improving element 50, are preferably good conductors of heat, such that heat does not build up in the nonrotating platen 20 or the image improving element 50 at the area of contact with imaging member 16 during printing.

It will be clear to one of skill in the art that means must be provided for unloading the nonrotating platen 20 of the present invention from the thermal printing head assembly 10 in order to insert the thermal imaging member 16 into the printing nip at the start of printing. Unloading can include removing a biasing force urging the platen 20 against the thermal printing head assembly 10. Three exemplary methods for achieving such an unloading are illustrated in FIG. 6, FIG. 7, and FIG. 8.

Figure 6:
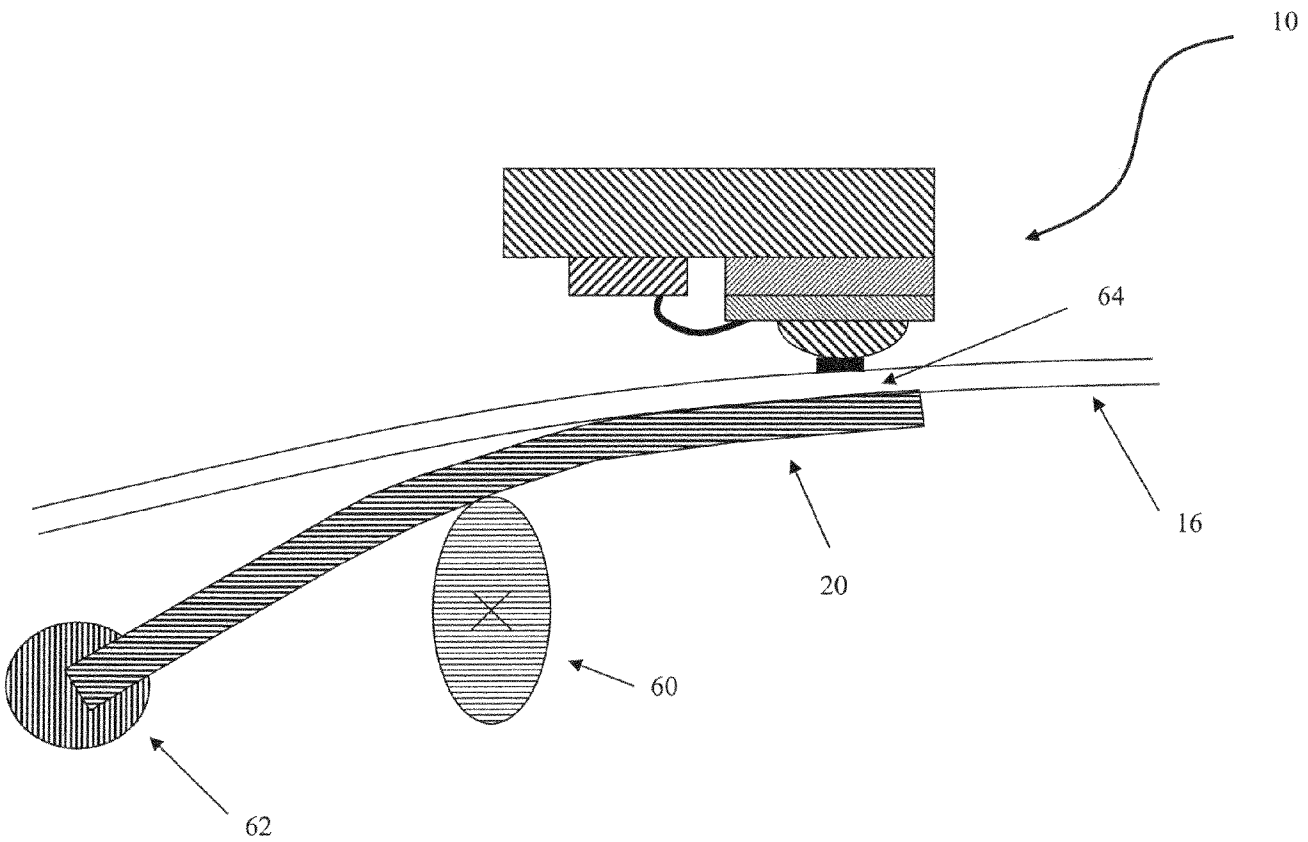
FIG. 6, not to scale, is a cross-sectional view of a nonrotating platen and biasing cam arrangement of the present invention.

Referring to FIG. 6 at least one rotatable cam 60 is provided in communication with the nonrotating platen 20. Any suitable axis of rotation of cam 60 may be used. In this case, the anchor 22 has been replaced by a pivot about which nonrotating platen 20 can rotate. The cam 60 is located between the pivot 62 and the printing nip 64. A preferred location of cam 60 will of course depend upon the dimensions and physical properties of the nonrotating platen 20 and associated thermal printing head assembly 10. In a loaded position, the thermal printing head assembly 10 exerts a torque on the nonrotating platen 20 about the cam 60.

In FIG. 6, the cam 60 is shown as located between pivot 62 and printing nip 64. It is also possible that a cam 60 could be located on the opposite side of a pivot from the printing nip.

Figure 7:
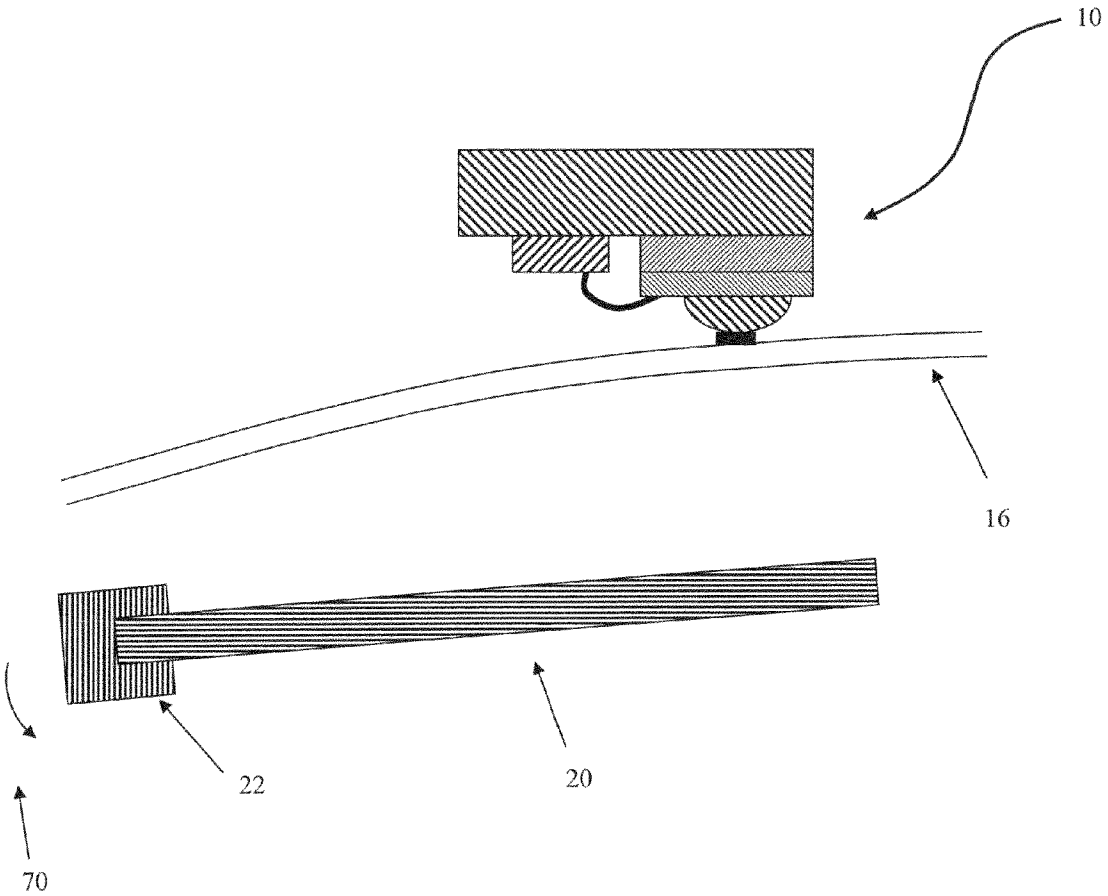
FIG. 7, not to scale, is a cross-sectional view of a nonrotating platen and biasing arrangement of the present invention in which the nonrotating platen is not loaded against the thermal printing head.
Figure 8:
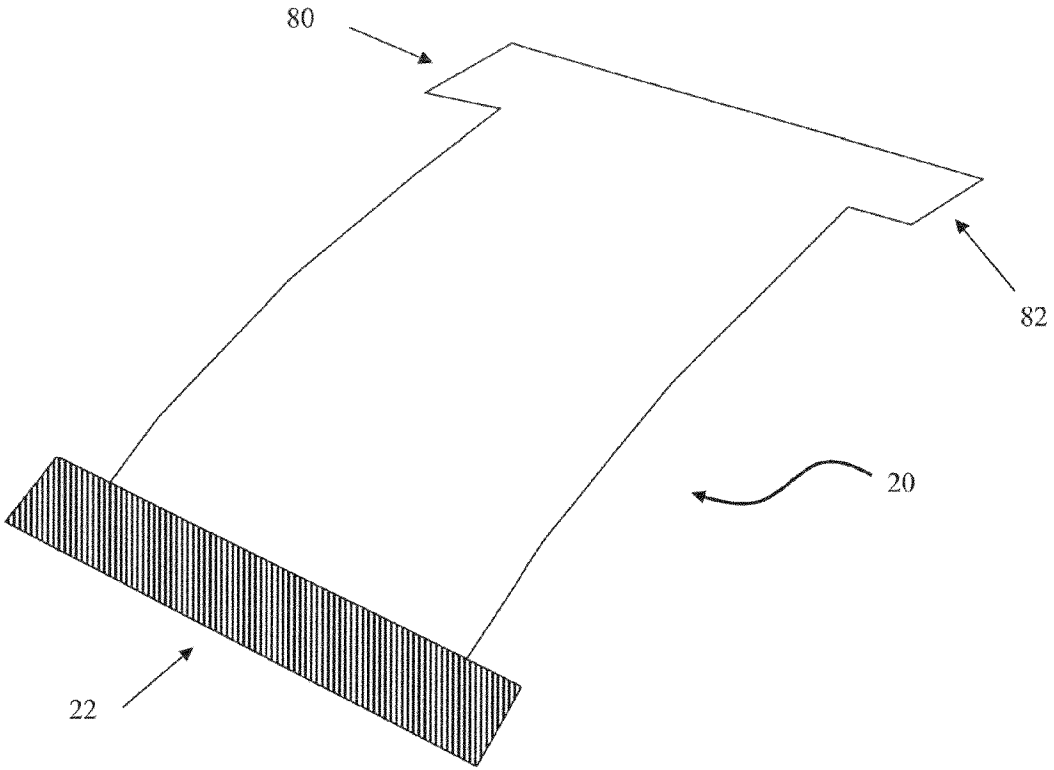
FIG. 8, not to scale, is a perspective view of a nonrotating platen of the present invention.

Rather than a separate cam 60, unloading of the nonrotating platen 20 can be accomplished by a rotation of the anchor 22, as shown in FIG. 7. The anchor 22 forms a pivot point about which the nonrotating platen 20 can pivot. FIG. 7 shows the anchor 22 rotated so as to unload the nonrotating platen 20 from the thermal printing head assembly 10. When the thermal imaging member is inserted, rotation of the anchor 22 in the direction of a reference arrow 70 causes the loading of the nonrotating platen 20, since the thermal printing head assembly 10 now exerts a force on nonrotating platen 20 that provides a torque about anchor 22.

FIG. 8 shows two tabs 80, 82 fixedly attached to the nonrotating platen 20. In some embodiments, the tabs 80, 82 are integrally formed with the nonrotating platen 20. The tabs 80, 82 can be used for unloading the nonrotating platen 20 from the printing nip. A suitably directed force applied to one or more of the tabs 80, 82 urges the nonrotating platen 20 away from the printing head assembly 10, thereby reducing or relieving pressure within the printing nip. Tabs 80 and 82 can extend beyond a width of the thermal imaging member 16, allowing for application of a force to one or more of the tabs 80, 82 for insertion of the thermal imaging member into the printing nip without interfering with translation of the thermal imaging member along a transport direction.

EQUIVALENTS

Although the invention has been described in detail with respect to various preferred embodiments, it is not intended to be limited thereto, but rather those skilled in the art will recognize that variations and modifications are possible which are within the spirit of the invention and the scope of the appended claims.

We claim:

1. A thermal printer for use with a thermal imaging member comprising:

a rigid frame;

a thermal printing head attached to the rigid frame; and a nonrotating platen comprising a heating element mounted to the printer frame, wherein the nonrotating platen is made of a material which has elasticity and thermal conductivity, wherein the elasticity allows the platen to (a) bias a thermal imaging member against the thermal print head for printing purposes, and (b) bend to apply approximately uniform pressure across the width of the thermal printing head when so biased, and wherein the heating element is adapted to raise the temperature of the thermal imaging member before it is printed by the thermal printing head.

2. The thermal printer of claim 1, wherein the pressure applied between the nonrotating platen and the thermal printing head is between about 0.5 and 10 pounds-per-linear-inch measured in the direction parallel to a line of heating elements of the thermal printing head during printing.

3. The thermal printer of claim 1, wherein the platen comprises at least one tab extending beyond a width of the thermal imaging member as measured in the direction perpendicular to a transport direction of the thermal imaging member.

4. The thermal printer of claim 3, wherein a force exerted on the tab causes a pressure applied between the platen and the thermal printing head to be relieved.

5. The thermal printer of claim 1 further comprising a cam in communication with the platen, and oriented such that rotation of the cam relieves torque exerted on the elastic member.

6. A method for thermally forming an image on a thermal imaging member comprising:

placing a portion of the thermal imaging member in a printing nip formed between a thermal print head and a non rotating platen, wherein during image forming, a portion of the platen in contact with the imaging member is stationary; biasing the thermal imaging member against the thermal printing head for printing purposes;

preheating at least a portion of the thermal imaging member prior to entry into the printing nip; and translating the thermal imaging member along a transport direction through the printing nip, at least one surface of the thermal imaging member sliding across the platen, the thermal print head forming an image upon the translated thermal imaging member;

wherein the platen is mounted to a printer frame and is made of a material which has elasticity and thermal conductivity, wherein the elasticity allows the platen to (a) bias a thermal imaging member against the thermal print head for printing purposes, and (b) bend to apply approximately uniform pressure across the width of the thermal printing head when so biased.

7. A method for thermally forming an image on a thermal imaging member comprising:

placing a portion of the thermal imaging member in a printing nip formed between a thermal print head and a non rotating platen, wherein during image forming, a portion of the platen in contact with the imaging member is stationary; biasing the thermal imaging member against the thermal printing head for printing purposes;

translating the thermal imaging member along a transport direction through the printing nip, at least one surface of the thermal imaging member sliding across the platen, the thermal print head forming an image upon the translated thermal imaging member;

exerting a force to the platen to vary or to relieve pressure between the platen and the thermal printing head and varying exertion of the force by rotating a cam in communication with the platen;

wherein the platen is mounted to a printer frame and is made of a material which has elasticity and thermal conductivity, wherein the elasticity allows the platen to (a) bias a thermal imaging member against the thermal print head for printing purposes, and (b) bend to apply approximately uniform pressure across the width of the thermal printing head when so biased.

* * * * *

UNITED STATES PATENT AND TRADEMARK OFFICE

CERTIFICATE OF CORRECTION

PATENT NO. : 8,305,408 B2
APPLICATION NO. : 11/753753
DATED : November 6, 2012
INVENTOR(S) : Launie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1123 days.

Signed and Sealed this
Eleventh Day of November, 2014

Michelle K. Lee

Michelle K. Lee
*Deputy Director of the United States Patent and Trademark Office*